US007670188B2

(12) United States Patent
Zhang et al.

(10) Patent No.: US 7,670,188 B2
(45) Date of Patent: Mar. 2, 2010

(54) ELECTRICAL CARD CONNECTOR WITH IMPROVED SPRING TAB

(75) Inventors: Shi-Gui Zhang, Kunshan (CN); Xiao-Min An, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,558

(22) Filed: Dec. 26, 2008

(65) Prior Publication Data

US 2009/0163081 A1 Jun. 25, 2009

(30) Foreign Application Priority Data

Dec. 25, 2007 (CN) ..... 2007 2 0129683

(51) Int. Cl.
*H01R 24/00* (2006.01)

(52) U.S. Cl. ..... 439/630

(58) Field of Classification Search ..... 439/630
See application file for complete search history.

(56) References Cited

U.S. PATENT DOCUMENTS 6,764,323 B2 * 7/2004 Shimada et al. ..... 439/138
6,994,574 B1 2/2006 Lai
7,083,473 B1 8/2006 Lai
7,309,259 B2 * 12/2007 Sun et al. ..... 439/630
7,396,239 B2 * 7/2008 Harasawa et al. ..... 439/136
7,448,889 B1 * 11/2008 Ho et al. ..... 439/159
2003/0081388 A1 * 5/2003 Yang ..... 361/737
2004/0110423 A1 * 6/2004 Shishikura et al. ..... 439/630

FOREIGN PATENT DOCUMENTS

CN ZL 200520109157.4 1/2007

* cited by examiner

*Primary Examiner*—Tho D Ta
*Assistant Examiner*—Travis Chambers
(74) *Attorney, Agent, or Firm*—Wei Te Chung; Andrew C. Cheng; Ming Chieh Chang

(57) ABSTRACT

An electrical card connector includes an insulative housing defining a card receiving space, a plurality of contacts for mating with a first card and a second card wider than the first card, and a spring tab at one side of the card receiving space. The spring tab includes a retaining portion fixed to the insulative housing and a body portion extending from the retaining portion. The body portion includes a bend portion extending from a lateral side of the body portion under a condition that the first card is sidewardly restricted by the bend portion with insertion of the first card into the card receiving space, and body portion is deformable to let the second card overstepping the body portion with insertion of the second card into the card receiving space.

19 Claims, 7 Drawing Sheets

7

ELECTRICAL CARD CONNECTOR WITH IMPROVED SPRING TAB

BACKGROUND OF THE INVENTION

1. Field of the Invention

The present invention relates to electrical card connectors, more particularly to electrical card connectors with simple spring tab for restricting and guiding insertion of corresponding cards.

2. Description of Related Art

Nowadays, memory cards are widely used in electronic devices. There are many kinds of memory cards such as MMC (Multi Media) card, SD (Secure Digital) card, xD (xD-Picture) card, MS (Memory Stick) card and MS (Memory Stick) Duo card. According to the standard specification, the dimension of the MS card is 50 mm×21.5 mm×2.8 mm and the dimension of the MS Duo card is 31 mm×20 mm×1.6 mm. It is obvious that the MS card is wider and thicker than the MS Duo card.

Electrical card connectors are usually mounted on a PCB of the electronic devices to establish data transmission between the memory cards and the electronic devices. It is a common knowledge to those of ordinary skill in the art to know that both the MS card and the MS Duo card are compatible to a MS card connector or a multiple-in-one card connector having MS card contacts. Since the MS card and the MS Duo card have different widths, usually, a side wall can't meet a demand of restricting both the MS and the MS Duo cards.

Chinese Patent No. ZL 200520109157.4 discloses a card connector with additional restriction structure to solve the above problem. The card connector includes an insulative housing, a plurality of contact mounted on the insulative housing and a rotatable member mounted at an insertion opening of the insulative housing. The insulative housing defines a card receiving chamber communicating with the insertion opening for alternatively accommodating the MS card and the MS Duo card, and a pair of side walls with the card receiving chamber located therebetween. The rotatable member includes a pivot portion and a pair of elastic springs abutting against the pivot portion. The pivot portion includes a pair of slant walls extending from lateral sides thereof and extending into the card receiving chamber. When the MS card is inserted into the card receiving chamber through the insertion opening, it downwardly abuts against the slant walls of the pivot portion to drive the pivot portion downwardly rotatable along a horizontal axis. As a result, the MS card can overstep the pivot portion and is sidewardly restricted by the pair of side walls in order to prevent the MS card from rocking along a left-to-right direction. When the MS Duo card is inserted into the card receiving chamber through the insertion opening, it is restricted between the pair of slant walls and can be prevented from rocking along the left-to-right direction as well.

However, it is obvious that the structure of the rotatable member is very complex and difficult for manufacture and assembly. Hence, an improved electrical card connector with simple card restriction structure is needed to solve the problem above.

BRIEF SUMMARY OF THE INVENTION

An electrical card connector includes an insulative housing and a plurality of contacts retained in the insulative housing for mating with a first card and a second card which is wider than the first card. The insulative housing includes a card receiving space for alternatively receiving the first and the second cards and a side wall located at a lateral side of the card receiving space. The side wall defines a slot in communicating with the card receiving space for guiding insertion of the second card. Each contact includes a contact portion extending into the card receiving space for mating with the first and the second cards. The electrical connector further includes a spring tab having a retaining portion fixed to the insulative housing and a body portion extending from the retaining portion. The body portion is located at the slot and including a bend portion extending from a lateral side of the body portion under a condition that the first card is sidewardly restricted by the bend portion with insertion of the first card into the card receiving space, and body portion is deformable to let the second card overstepping the body portion with insertion of the second card into the card receiving space. As a result, both of the first and the second cards can be restricted by corresponding structures in order not to rock along a left-to-right direction in the card receiving space.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
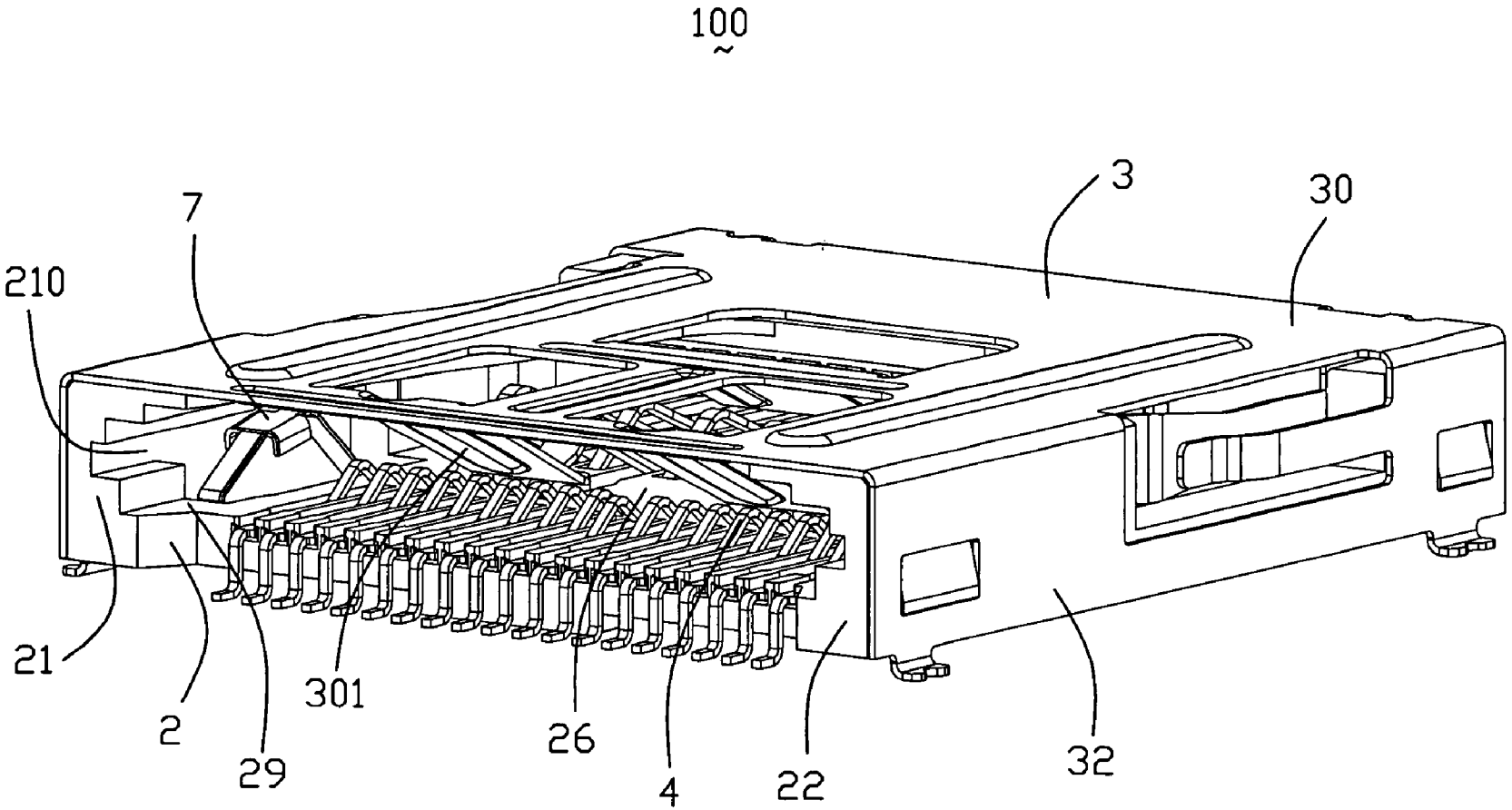
FIG. 1 is a perspective view of an electrical card connector according to a preferred embodiment of the present invention.
Figure 2:
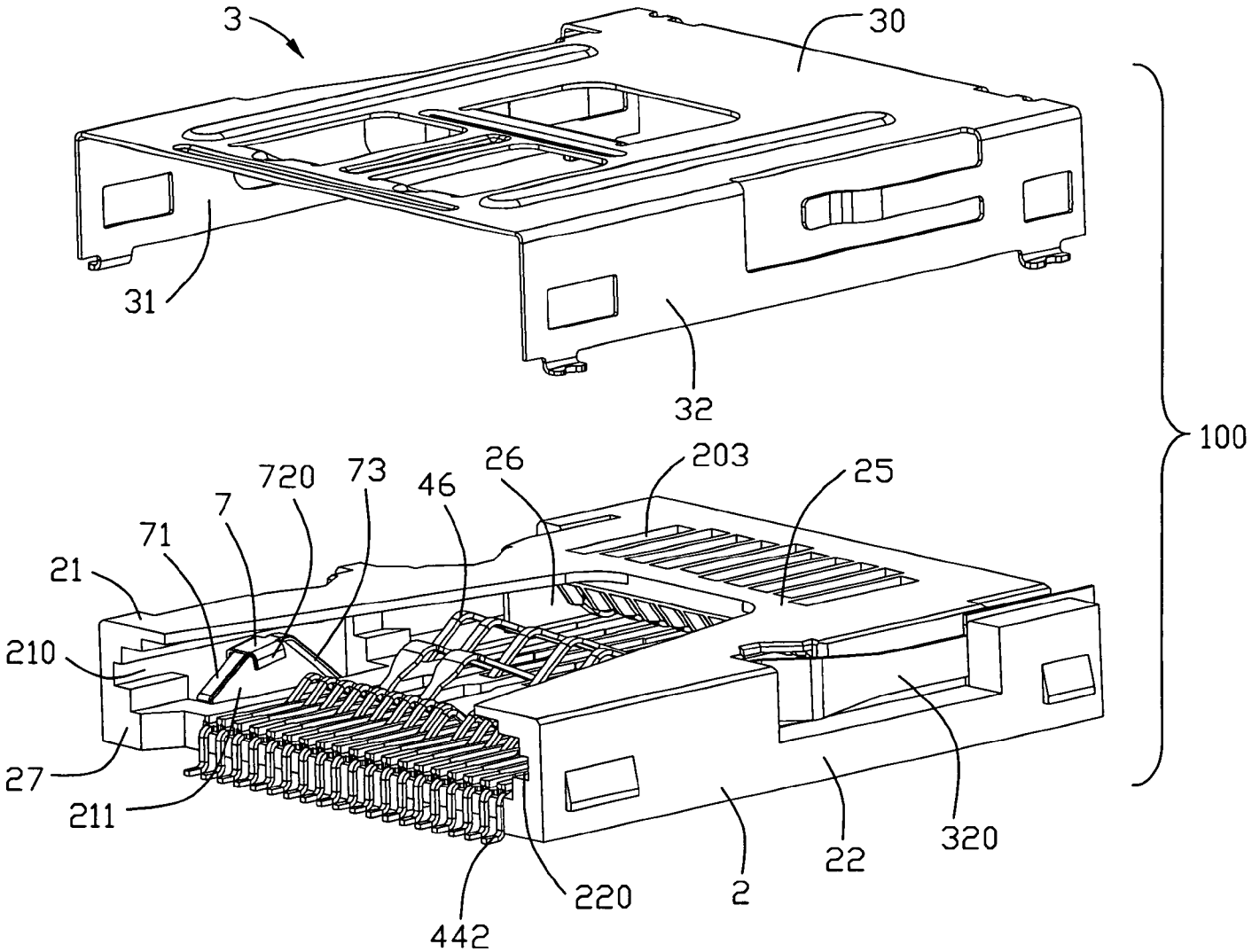
FIG. 2 is a part exploded view of the electrical card connector showing a metal shell depart from an insulative housing.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-9, an electrical card connector 100 for being mounted on a PCB (not shown) can be used for insertion of many kinds of cards 8 such as xD card, SD card, MMC card, MMCplus card, MS Duo card 81 and MS card 82, as best shown in FIGS. 6-9. It is a common knowledge that the MS card 82 is wider, thicker and longer than the MS Duo card 81. In order to simplify description hereinafter, the MS Duo card 81 is also named the first card 81, and the MS card 82 is also named the second card 82. Both the first and the second cards 81, 82 include flat contact pads 80 for electrically mating with the electrical card connector 100. The electrical card connector 100 includes an insulative housing 2, a plurality of contacts 4 for mating with contact pads 80 of the corresponding cards 8, a metal shell 3 covering the insulative housing 2 and a pair of metal spring tabs 7. The contacts 4 are divided into a first contact group 41, a second contact group 42, a third contact group 43 and a fourth contact group 44 arranged along a card insertion direction as shown FIGS. 2 and 4 for mating with the different kinds of cards 8.

The insulative housing 2 includes a rear mounting wall 20, a pair of first and second side walls 21, 22 extending forwardly from lateral sides of the mounting wall 20, and top and bottom walls 25, 24 connecting the mounting wall 20 and the pair of side walls 21, 22. The insulative housing 2 further includes a front mating face 27 opposite to the mounting wall 20 with a card receiving space 26 recessed from the mating face 27 and extending backwardly. The card receiving space 26 is located between the first and the second side walls 21, 22. The mounting wall 20 defines a plurality of first passageways 201. Each contact of the first, the second and the third contact groups 41, 42, 43 includes a retaining portion 45 fixed in the first passageways 201, a flexible contact portion 46 protruding into the card receiving space 26 and a soldering portion 47 backwardly extending beyond the mounting wall 20.

The first and the second side walls 21, 22 respectively define first and second guiding slots 210, 220 communicating with the card receiving space 26 for guiding insertion of the MS card 82, and first and second depressions 211, 221 communicating with the first and the second guiding slots 210, 220, respectively. The first and the second depressions 211, 221 further extend downwardly through the first and the second side walls 21, 22, respectively, in order to provide reasonable space for deformation of the spring tabs 7. The bottom wall 24 defines a plurality of second passageways 202 for deformation of the second, third and fourth contact groups 42, 43, 44. The top wall 25 defines a plurality of third passageways 203 communicating with the card receiving space 26 for deformation of the first contact group 41.

The fourth contact group 44 includes a plurality of front contacts arranged adjacent to the mating face 27. Each front contact includes a front contact portion 441 cantileveredly extending into the card receiving space 26 and a front soldering tail 442 extending from the front contact portion 441 and further extending beyond the mating face 27 of the insulative housing 2.

Figure 3:
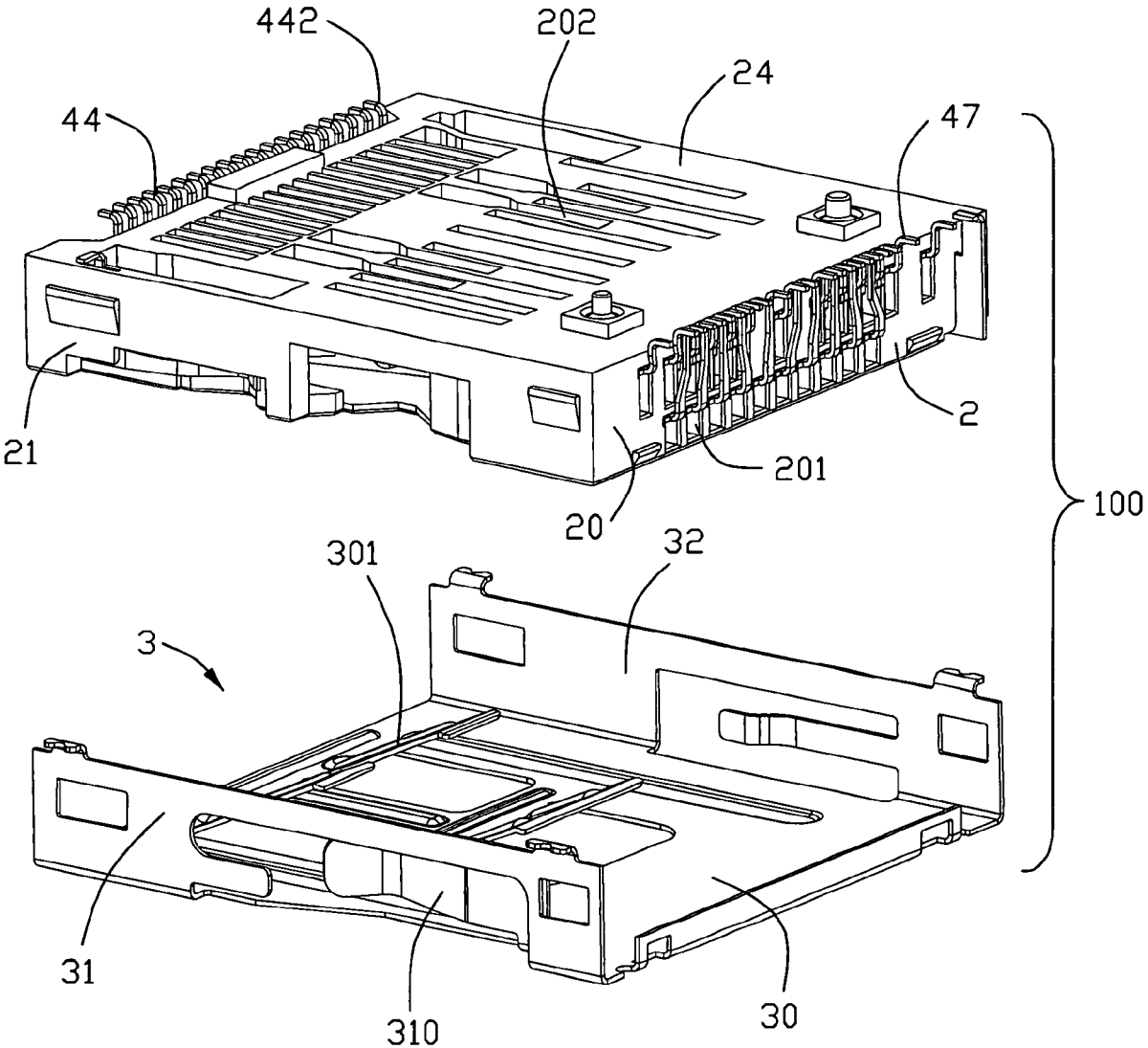
FIG. 3 is a part exploded view of the electrical card connector similar to FIG. 2, but taken from another aspect.
Figure 4:
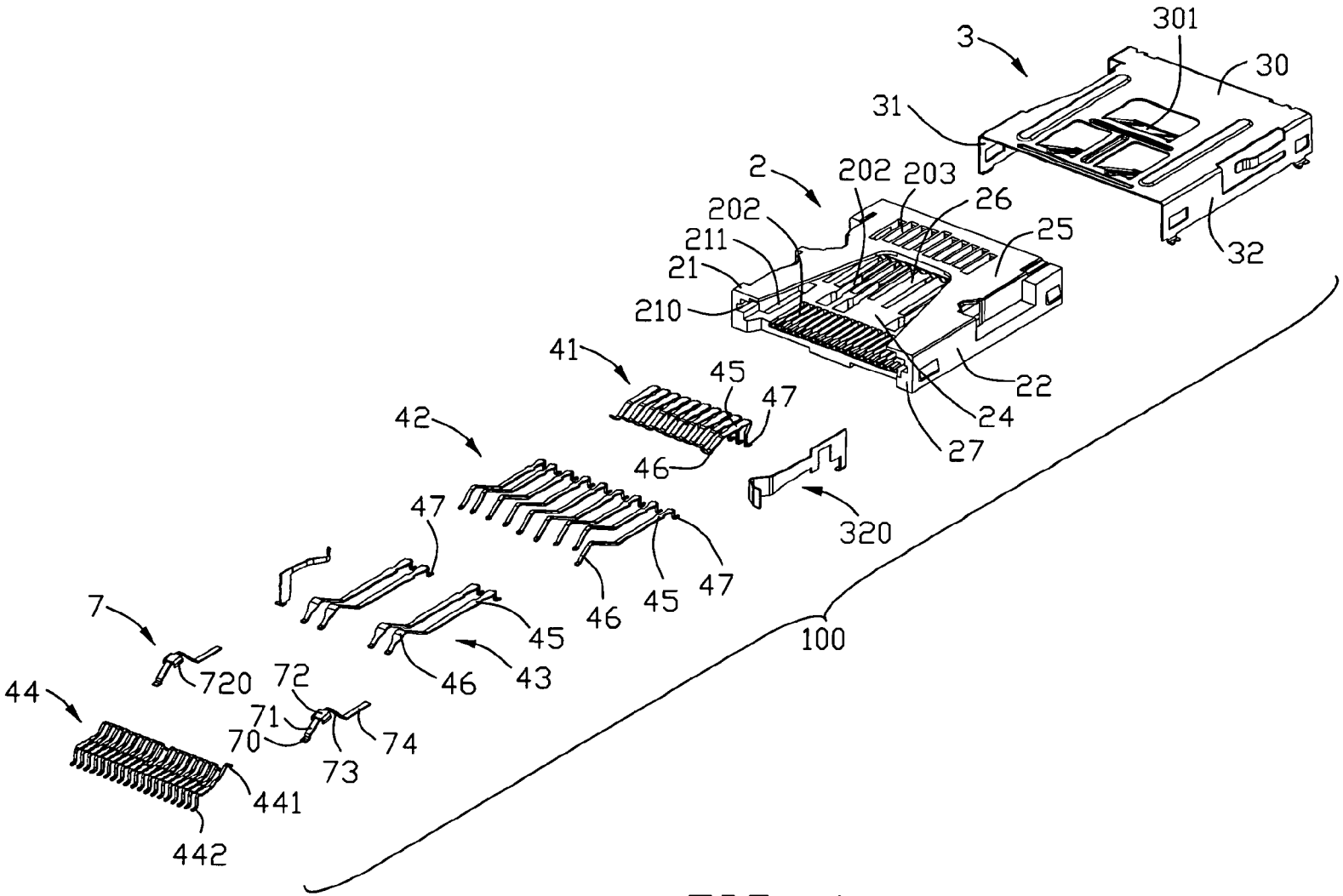
FIG. 4 is an exploded view of the electrical card connector.
Figure 5:
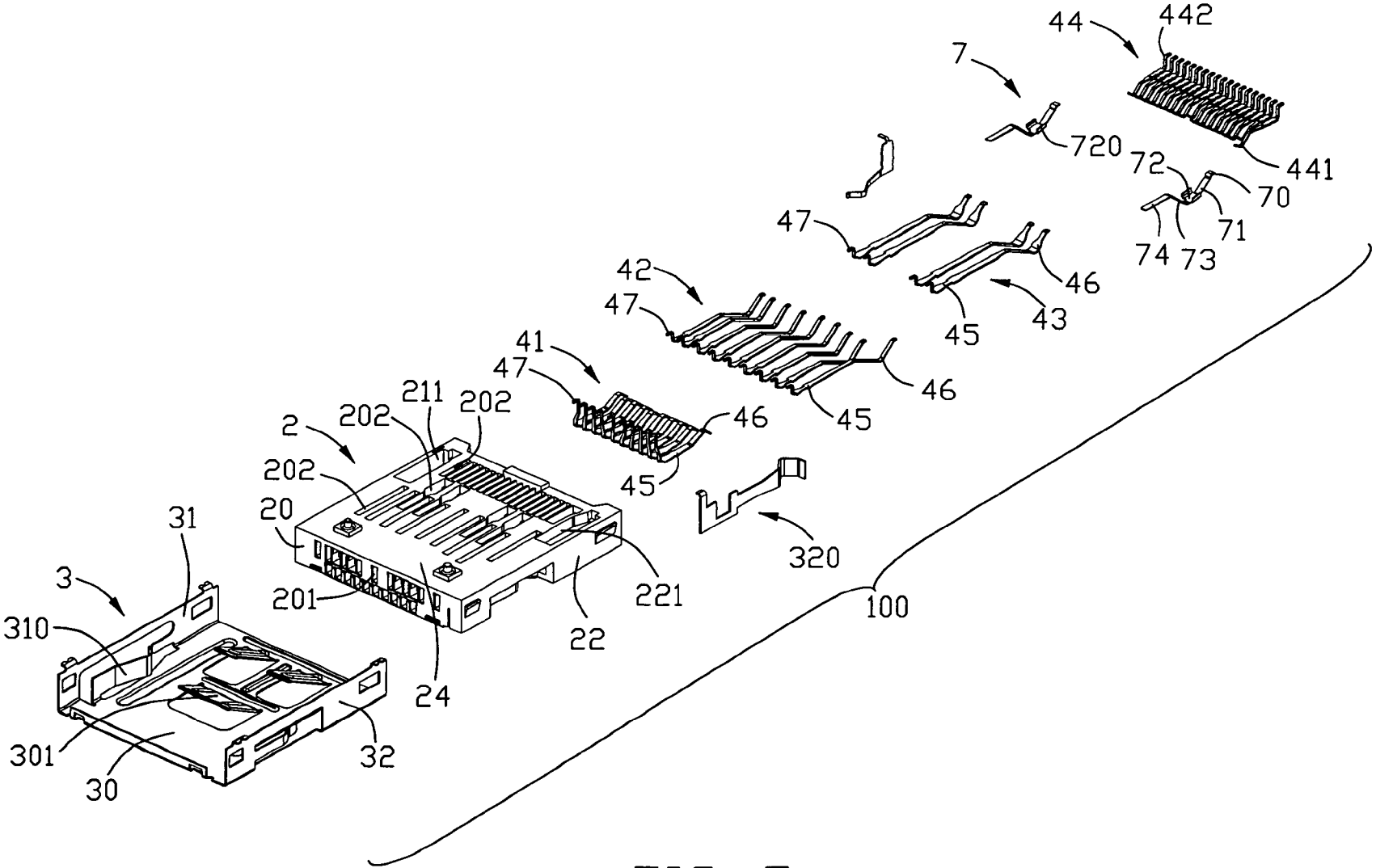
FIG. 5 is another exploded view of the electrical card connector while taken from another aspect.
Figure 6:
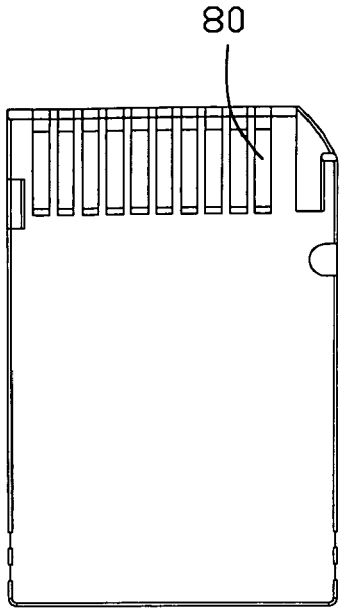
FIG. 6 is a bottom view of a first card which can be inserted into the electrical card connector.
Figure 7:
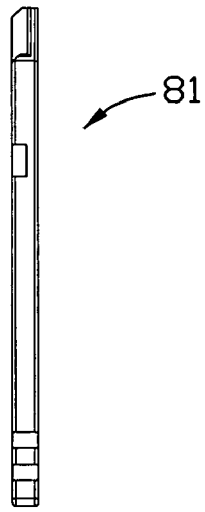
FIG. 7 is a side view of the first card.
Figure 8:
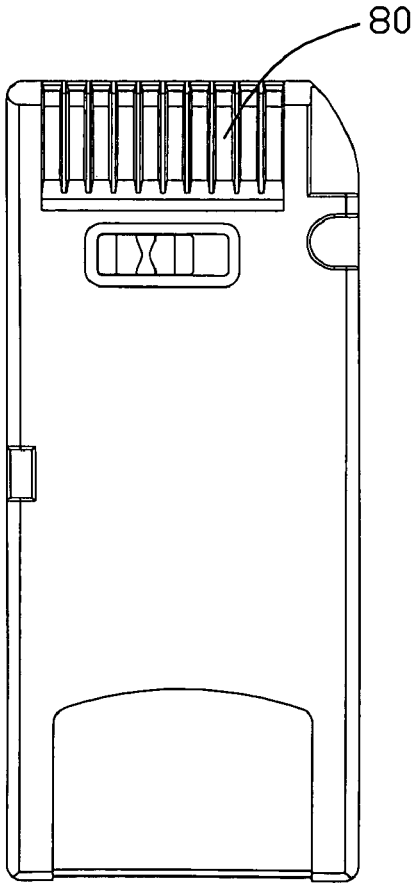
FIG. 8 is a bottom view of a second card which can be inserted into the electrical card connector as well.
Figure 9:
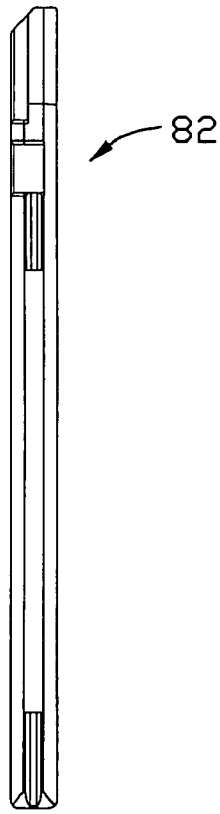
FIG. 9 is a side view of the second card.
Figure 10:
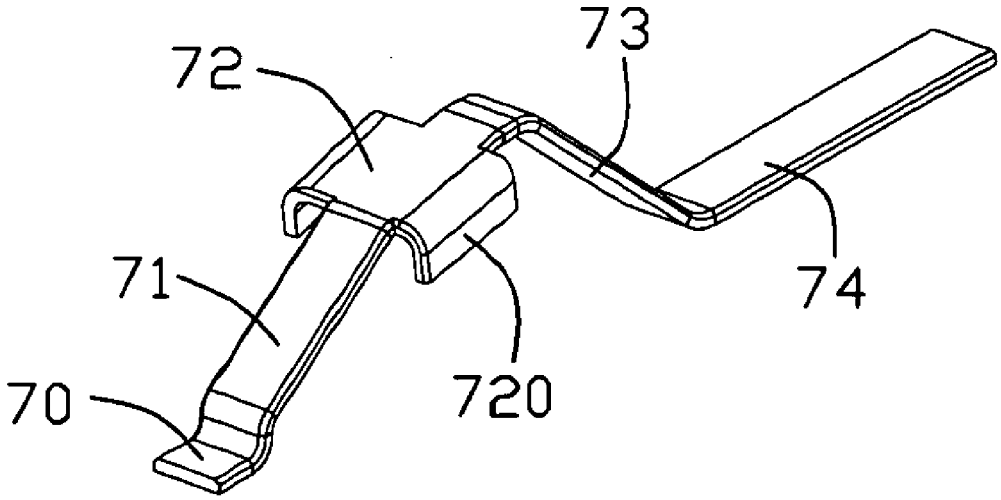
FIG. 10 is a perspective view of a spring tab according to the preferred embodiment of the present invention.

Referring to FIGS. 3-5, the metal shell 3 is stamped from a metal sheet and includes a top face 30 and a pair of side faces 31, 32 extending downwardly from lateral edges of the top face 30. The top face 30 includes a plurality of pressing tabs 301 extending into the card receiving space 26 for abutting against the corresponding cards 8. As shown in FIG. 3, the metal shell 3 includes a first clip contact 310 adjacent to the first side wall 21 and located at one side of the card receiving space 26. The electrical connector 100 further includes a second clip contact 320 fixed in the second side wall 22 at the other side of the card receiving space 26. The first and the second clip contacts 310, 320 are located at opposite sides of the card receiving space 26 for abutting against the first and the second cards 81, 82 in order to firmly hold such cards 81, 82 in the card receiving space 26.

Referring to FIGS. 2, 4, 5 and 10, the pair of spring tabs 7 function as a card restriction structure for sidewardly restricting opposite sides of the MS Duo card 81. According to the preferred embodiment of the present invention, the pair of spring tabs 7 are mainly located at the corresponding first and the second guiding slots 210, 220, and located at a pass road of the MS card 82. Each spring tab 7 includes a flat retaining portion 74 fixed to the insulative housing 2 and a body portion 72 extending from the retaining portion 74. The retaining portion 74 is located in a horizontal plane. The body portion 72 cantileveredly extends into the corresponding first and the second guiding slots 210, 220, and includes a rear slant portion 73 upwardly and forwardly extending from the retaining portion 74 and a front slant portion 71 downwardly and forwardly extending from the rear slant portion 73. The front slant portion 71 includes at least one bend portion 720 extending downwardly from a lateral edge thereof and extending in a vertical plane. The front slant portion 71 includes a flat free end portion 70 higher than the retaining portion 74 before insertion of the MS card 82 into the card receiving space 26. The insulative housing 2 includes a press portion 29 (shown in FIG. 1) abutting against the free end portion 70 in order to prevent upwardly over-deformation of the body portion 72. It is obvious that the bend portion 720 can extend from the rear slat portion 73 instead of the front slant portion 71 in other embodiments to reach the same function of the present invention. The retaining portion 74 acts as a pivot for deformation of the body portion 72 when the MS card 81 is inserted into the card receiving space 26, which will be detailed hereinafter. According to the preferred embodiment of the present invention, the spring tab 7 is abutted to deform due to its own elasticity. The spring tabs 7 can be assembled to the insulative housing 2 or can be embedding-molded with the insulative housing 2 in order to fix the spring tabs 7 to the insulative housing 2. As a result, the structure of the spring tabs 7 is very simple and can be easily assembled to or molded with the insulative housing 2.

When the MS Duo card 81 is inserted into the card receiving space 26 through the mating face 27, the MS Duo card 81 is sidewardly restricted by the bend portions 72 so that the MS Duo card 81 can't rock along a left-to-right direction in the card receiving space 26.

When the MS card 82 is inserted into the card receiving space 26, the lateral sides of the MS card 82 is guided and supported by the first and the second guiding slots 210, 220. At the same time, the bottom surface of the MS card 82 slides along the front slant portions 71 to drive the body portion 72 downwardly deformable from the guiding slots 210, 220 to the corresponding depressions 211, 221. As a result, the MS card 82 oversteps the body portion 72 with further insertion of the MS card 82 into the card receiving space 26. The lateral sides of the MS card 82 are restricted by the first and the side walls 21, 22 of the insulative housing 2 so that the MS card 82 can't rock along the left-to-right direction as well in the card receiving space 26. The first and the second cards 81, 82 can be clipped by the first and the second clip contacts 310, 320 for firmly retention.

When the xD card is inserted along the corresponding parts of the first and the second guiding slots 210, 220 and into the card receiving space 26, the bottom surface of xD card is supported by the front slant portion 71 of the body portion 72 and downwardly presses the body portion 72. As a result, the front contact portions 441 can mechanically mate with the corresponding contact pads of the xD card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical card connector for insertion of a first card and a second card which is wider than the first card, comprising:

an insulative housing defining a card receiving space for alternatively receiving the first and the second cards and a side wall located at a lateral side of the card receiving space, the side wall defining a slot in communicating with the card receiving space for guiding insertion of the second card;

a plurality of contacts with contact portions extending into the card receiving space for mating with the first and the second cards; and a spring tab including a retaining portion fixed to the insulative housing and a body portion extending from the retaining portion, the body portion being located at the slot and comprising a bend portion extending from a lateral side of the body portion under a condition that the first card is sidewardly restricted by the bend portion with insertion of the first card into the card receiving space, and body portion being deformable to let the second card overstepping the body portion with insertion of the second card into the card receiving space.

2. The electrical card connector as claimed in claim 1, wherein the spring tab is made of metal material with the body portion cantileveredly extending into the slot, the retaining portion acting as a pivot for deformation of the body portion when the second card is inserted into the card receiving space.

3. The electrical card connector as claimed in claim 1, wherein the second card is a MS card and the first card is a MS Duo card, the second card being thicker than the first card as well.

4. The electrical card connector as claimed in claim 1, further comprising another spring tab opposite to the spring tab in condition that the first card is restricted between the spring tab and the another spring tab when the first card is inserted into the card receiving space.

5. The electrical card connector as claimed in claim 1, wherein the bend portion extends downwardly from the lateral side of the body portion.

6. The electrical card connector as claimed in claim 5, wherein the bend portion is located in a vertical plane.

7. The electrical card connector as claimed in claim 1, wherein the body portion comprises a rear slant portion upwardly and forwardly extending from the retaining portion and a front slant portion downwardly and forwardly extending from the rear slant portion.

8. The electrical card connector as claimed in claim 7, wherein the bend portion is located at the front slant portion.

9. The electrical card connector as claimed in claim 7, wherein the front slant portion comprises a free end portion higher than the retaining portion before insertion of the second card into the card receiving space.

10. The electrical card connector as claimed in claim 9, wherein the insulative housing comprises a press portion abutting against the free end portion in order to prevent upwardly over-deformation of the body portion.

11. An electrical card connector for insertion of a first card and a second card which is wider than the first card, comprising:

an insulative housing defining a card receiving space for alternatively receiving the first and the second cards and a side wall located at a lateral side of the card receiving space, the side wall defining a slot in communicating with the card receiving space for guiding insertion of the second card and a depression in communicating with the slot;

a plurality of contacts with contact portions extending into the card receiving space for mating with the first and the second cards; and a spring tab comprising a body portion cantileveredly extending into the slot and located at a pass road of the second card, the body portion comprising a bend portion under a condition that the first card is sidewardly restricted by the bend portion with insertion of the first card into the card receiving space, and body portion being moveable from the slot to the depression in order to let the second card overstepping the body portion with insertion of the second card into the card receiving space.

12. The electrical card connector as claimed in claim 11, wherein the bend portion extends downwardly from a lateral edge of the body portion and is located in a vertical plane.

13. The electrical card connector as claimed in claim 11, wherein the slot extends through a bottom wall of the insulative housing.

14. The electrical card connector as claimed in claim 11, further comprising a pair of clip contacts disposed on lateral sides of the contact portions for clipping the first and the second cards.

15. The electrical card connector as claimed in claim 11, wherein the spring tab is made of metal material and comprises a retaining portion fixed to the side wall, the retaining portion acting as a pivot for deformation of the body portion when the second card is inserted into the card receiving space.

16. The electrical card connector as claimed in claim 15, wherein the body portion comprises a rear slant portion upwardly and forwardly extending from the retaining portion and a front slant portion downwardly and forwardly extending from the rear slant portion.

17. The electrical card connector as claimed in claim 16, wherein the front slant portion comprises a free end portion higher than the retaining portion before insertion of the second card into the card receiving space.

18. An electrical card connector comprising:

an insulative housing cooperating with a metallic shell to define a card receiving space;

a plurality of contacts disposed in the housing with contacting sections extending into the card receiving space;

a restriction block formed on a front face of the housing and having an inner vertical face for compliantly receiving a thinner and narrower card, and an outer horizontal face for compliantly receiving a thicker and wider card; and a metallic spring tab mounted to the housing behind the restriction block and defining a main body being deflectable in a vertical direction; wherein said spring tab defines a bending portion essentially aligned with the inner vertical face for guiding insertion of the thinner and narrower card under condition of no deflection of the spring tab, and the main body defines a confrontation face aligned behind the outer horizontal face for guiding insertion of the thicker and wider card under condition of deflection of the spring tab.

19. The electrical card connector as claimed in claim 18, wherein said shell is equipped with at least one resilient pressing tab extending into the card receiving space to urge the thinner and narrower card to laterally confront the corresponding inner vertical face.

* * * * *